United States Patent [19]

Sanborn et al.

[11] 4,359,086

[45] Nov. 16, 1982

[54] HEAT EXCHANGE SURFACE WITH POROUS COATING AND SUBSURFACE CAVITIES

[75] Inventors: Duane F. Sanborn, La Crosse; John L. M. Holman, Onalaska; Chester D. Ware, La Crosse, all of Wis.

[73] Assignee: The Trane Company, La Crosse, Wis.

[21] Appl. No.: 264,519

[22] Filed: May 18, 1981

[51] Int. Cl.[3] ..... F28F 13/18

[52] U.S. Cl. ..... 165/133; 62/527; 165/DIG. 10

[58] Field of Search ..... 165/DIG. 10; 62/527; 165/133

[56] References Cited

U.S. PATENT DOCUMENTS

| | | | |
|---|---|---|---|
| 3,170,512 | 2/1965 | Smith | 165/DIG. 10 |
| 3,384,154 | 5/1968 | Milton | 165/1 |
| 3,696,861 | 10/1972 | Webb | 165/133 |
| 3,825,064 | 7/1974 | Inoue | 165/DIG. 10 |
| 3,990,862 | 11/1976 | Dahl et al. | 29/191.2 |
| 4,179,911 | 12/1979 | Saier et al. | 72/78 |
| 4,182,412 | 1/1980 | Shum | 165/133 |
| 4,232,056 | 11/1980 | Grant et al. | 165/DIG. 10 |
| 4,258,783 | 3/1981 | Alber | 62/527 X |

FOREIGN PATENT DOCUMENTS

| | | | |
|---|---|---|---|
| 52-14259 | 2/1977 | Japan | 165/133 |

OTHER PUBLICATIONS

Heat Transfer from Silicon Chips and Wafers, Noth, *IBM Technical Disclosure Bulletin,* vol. 17, No. 12, May 1975, p. 3544.

Tubular Hollow Cathode Sputtering onto Substrates of Complex Shape, Thornton et al., *J. Vac. Sci. Technol.,* vol. 12, No. 1, Jan./Feb. 1975, pp. 93–97.

Snap-on Nucleate Boiling Promoter, Chu et al., *IBM Technical Disclosure Bulletin,* vol. No. 3, Aug. 1968, pp. 277–278.

*Primary Examiner*—Sheldon J. Richter

*Attorney, Agent, or Firm*—Carl M. Lewis; Ronald M. Anderson

[57] ABSTRACT

A heat exchange surface having nucleate boiling cavities defined by subsurface cavities in combination with a thin porous coating. A preferred embodiment of the heat exchange surface includes a plurality of helical fins formed on the outer surface of a metallic tube, the tips of which are deformed by rolling to define gaps opening into fin cavities between adjacent fins. A porous open-celled coating flame-sprayed on the deformed portion of the fins substantially bridges these gaps, except at random open points caused by the inherent porosity of the coating. These openings in the porous coating in combination with the fin cavities provide nucleate boiling sites which promote efficient heat transfer for boiling a liquid.

10 Claims, 2 Drawing Figures

HEAT EXCHANGE SURFACE WITH POROUS COATING AND SUBSURFACE CAVITIES

DESCRIPTION

1. Technical Field

This invention generally pertains to a heat transfer surface, and specifically to a surface having subsurface cavities and a porous coating for improved nucleate boiling capability.

2. Background Art

To achieve a high heat transfer efficiency for boiling a liquid, a surface should provide nucleate boiling sites wherein vapor bubbles can readily form, with minimum superheat of the surrounding liquid. These nucleate boiling sites or cavities should have re-entrant openings of the proper dimension in order to draw-in liquid by capillary action and to retain a portion of each escaping vapor bubble to act as a seed for subsequent bubble formation. In addition, a supply of superheated liquid must be readily available to the nucleation sites to insure the continuous production of vapor bubbles.

Nucleate boiling cavities may be provided by applying a porous coating to a surface. For example, U.S. Pat. No. 3,990,862 to Dahl et al. discloses a process for flame-spraying oxidized metallic particles onto a metal substrate to form a porous open-celled coating. This type of porous surface has been successfully used commercially as a coating on tubes in evaporative heat exchangers of refrigeration systems. In these heat exchangers, a fluid such as water is circulated through the tubes and is cooled by giving up heat which is transferred through the tube wall to evaporate a refrigerant liquid surrounding the tubes.

The flame-sprayed coating applied as taught in the Dahl patent provides a very efficient heat transfer surface for most commonly used refrigerants, with the exception of refrigerant 11 (R-11). This is believed to be due to the higher surface tension characteristic of R-11 as compared to other commonly used commercial refrigerants, such as R-12 or R-22. A liquid with greater surface tension requires a nucleate boiling cavity having a larger equivalent radius in order to efficiently form and emit vapor bubbles, i.e., to boil the liquid with minimum superheat. Although smaller cavities may act as nucleation sites, it is believed that a liquid such as R-11 does not feed into these cavities after a vapor bubble is emitted as effectively as it feeds a nucleation site of larger dimension. A means for feeding liquid into cavities which are predominantly smaller than the optimum size, or a means for increasing their apparent size would be required to improve the performance of such a surface.

Various heat transfer surfaces are in use having fins which are bent over, split, or crushed to define elongated re-entrant cavities for inducing nucleate boiling in a liquid. Examples of such surfaces are disclosed in U.S. Pat. Nos. 3,696,861 to Webb, and 4,179,911, to Saier et al. As explained in the Webb patent, this type of surface provides a gap of the proper dimension between adjacent fin tips, which acts as a re-entrant opening to the fin cavity, forming a nucleation site which permits vapor bubbles to escape while retaining a supply of superheated liquid. Superheated liquid thus feeds the nucleation sites by lateral flow in the fin cavities along the root area between adjacent fins. However, it is difficult to crush or roll over fins to form gaps which are consistently within the required dimensional range. For this reason, it is somewhat difficult to manufacture this type surface on an economical commercial scale.

It will thus be apparent that both the porous boiling surface and the finned boiling surface each have complementary advantages and drawbacks. Specifically, the nucleate boiling cavity dimensions prevalent in a porous boiling surface may not be optimum for efficient nucleate boiling of a particular liquid; and although the cavity dimensions of a finned surface may be adequate, it is difficult to commercially manufacture gaps between adjacent fins which are consistently within the required dimensional range for efficient nucleate boiling.

It is thus an object of this invention to provide a relatively low cost heat transfer surface for boiling a variety of liquids, and especially efficient in boiling liquids such as R-11.

It is a further object of this invention to provide an efficient heat transfer surface which includes nucleate boiling sites having means for adequately supplying those sites with liquid.

It is a still further object of this invention to provide a finned heat transfer surface having crushed, rolled-over, or split fin tips wherein a consistent dimension for the gap between adjacent fin tips is not critical for efficient nucleate boiling.

Yet a still further object of this invention is to provide an efficient heat transfer surface having a porous coating in combination with a finned surface for defining nucleate boiling cavities, wherein these cavities are provided with superheated liquid by means of the fin cavities formed in the finned surface and through openings in the porous surface.

These and other objects of the subject invention will become evident from the disclosure which follows and by reference to the attached drawings.

BRIEF SUMMARY OF THE INVENTION

The subject invention is a heat exchange surface comprising a metallic surface having a plurality of generally parallel fins formed thereon. The tips of these fins are deformed to generally define a gap between adjacent fins which opens into a fin cavity at their root portion. A porous open-celled coating is deposited on the deformed portion of the fins, substantially bridging the gap between adjacent fins, except at random open points caused by the inherent porosity of the coating. This porous coating in combination with the fin cavities provides nucleate boiling cavities, which are thereby adapted to provide improved efficiency in boiling a liquid. In one embodiment, the porous open-celled coating is flame-sprayed onto the metallic surface.

DISCLOSURE OF THE PREFERRED EMBODIMENT

Figure 1:
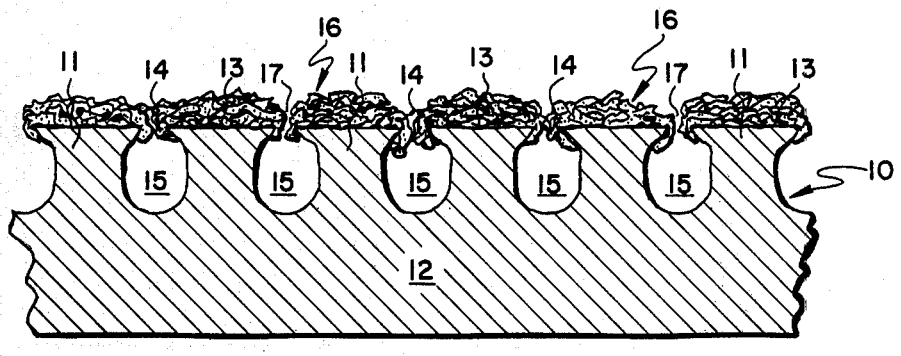
FIG. 1 shows a cross-sectional view of the heat transfer surface comprising the subject invention.

Referring to FIG. 1, a heat transfer surface comprising the present invention is generally denoted by reference numeral 10. Surface 10 comprises a plurality of generally parallel fins 11 formed on the surface of a metal substrate 12. FIG. 1 shows these parallel fins in a cross-sectional view transverse to their longitudinal axis. The tips 13 of fins 11 have been crushed by rolling, so that they are generally deformed into a "T" shape. Adjacent deformed fin tips 13 thus define gaps 14 opening into fin cavities 15 at the root of adjacent fins 11. A porous coating 16 adheres to the deformed fin tips 13 and generally extends over and substantially bridges gaps 14. Due to the porosity of porous coating 16, numerous randomly distributed openings 17 provide fluid communication between fin cavities 15 and a liquid to be boiled by heat transfer through surface 10.

Porous coating 16 may comprise either metallic or non-metallic particles which are cohesively and/or adhesively bound to each other and to fin tips 13 to form an open-celled coating which provides openings of the required dimension and which in combination with fin cavities 15 act as nucleate boiling sites for the liquid. In the preferred embodiment, porous coating 16 comprises oxidized aluminum particles which are flame-sprayed onto deformed fin tips 13 using a process similar to that taught in the Dahl patent. It is also contemplated that other types of porous coatings might be used, as for example, the sintered surface disclosed in U.S. Pat. No. 3,384,154 to Milton, or the electroplated graphite particle surface taught in U.S. Pat. No. 4,182,412 to Shum. There are also commercially known porous surfaces comprising glass, plastic, or ceramic beads or particles which may be bonded to the metallic surface of fin tips 13 with a suitable adhesive, to provide openings 17 of the proper dimension, i.e., porous openings of 1 to 5 mils in diameter.

A variety of materials may be used for the metallic substrate 12, depending upon the particular physical characteristics such as heat transfer coefficient or corrosion resistance, and the material cost requirements. For example, it is contemplated that metals such as aluminum, copper, titanium, or alloys thereof would be suitable for use as metal substrate 12. In the preferred embodiment, copper is used, primarily due to its high heat transfer conductivity. Further, it will be apparent that this invention is not limited to a tubular-shaped metal substrate, but may also be applied to a flat or a curved plate metal substrate 12.

Figure 2:
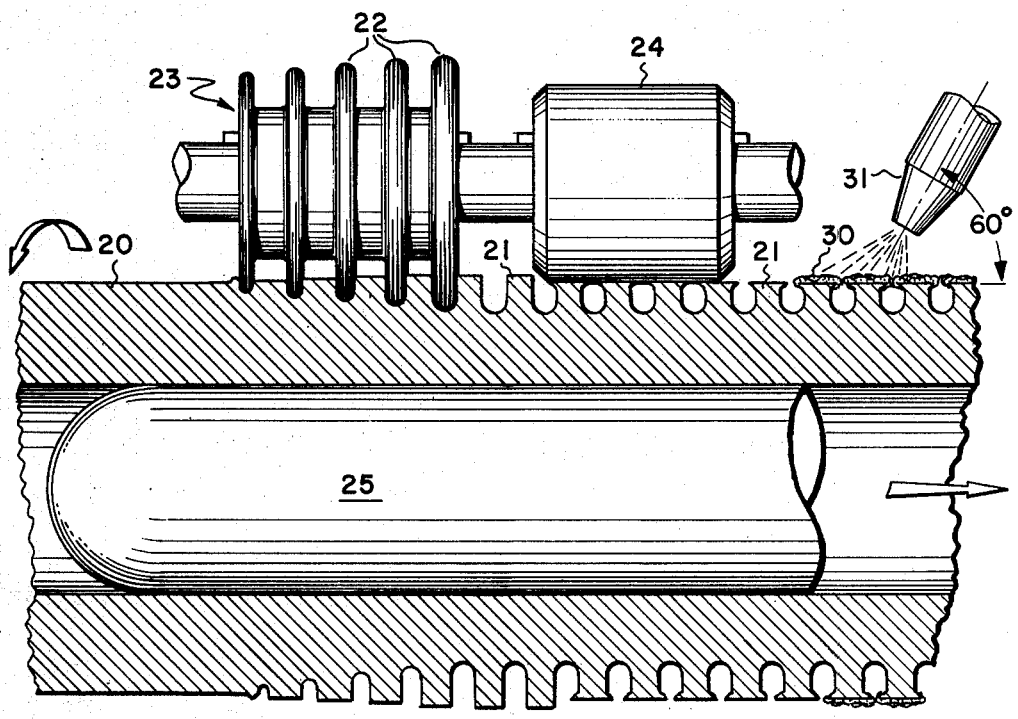
FIG. 2 schematically shows a method by which this surface may be manufactured in a preferred embodiment, as the exterior of a heat exchanger tube.

Turning now to FIG. 2, a method for producing the subject heat transfer surface on the exterior of a metallic tube is generally shown in schematic form. In this process, a copper tube 20 is subjected to a generally conventional rolling process for forming fins 21. In this process the material constituting the walls of tube 20 is displaced by the rolling discs 22 of rolling tool 23. As shown in FIG. 2, from left to right, each of rolling discs 22 is successively larger in diameter and of thicker cross section. Although only one rolling tool 23 is shown, one to three additional rolling tools 23 would normally be provided in the rolling process, spaced apart, parallel to and around the longitudinal axis of tube 20. Rolling tool 23 further includes a flattening roller 24 for deforming the tips of fins 21 generally into a "T"-shaped configuration. During the rolling process, a tube mandrel 25 supports the walls of tube 20 to properly form fins 21. Radial deformation of the wall of tube 20 is not shown in this schematic representation of the rolling process.

Tube 20 is caused to rotate relative to rolling tools 23; or, in the alternative, rolling tools 23 may be caused to orbit about the axis of tube 20. The rotational axis of discs 22 is set at a slight angle relative to the longitudinal axis of tube 20 such that discs 22 form helical fins 21 on the exterior surface of tube 20. The skew angle at which discs 22 contact tube 20 assists in the movement of the tube past the rolling tool 23; in FIG. 2, tube 20 is represented as moving from left to right relative to rolling tool 23.

Due to the variations of wall thickness and working properties of the metal in tube 20, and the dynamic variations resulting from the fin forming process, the gap between adjacent fins 21 created during their deformation by flattening roller 24 can vary substantially from point-to-point on tube 20. For efficient nucleate boiling in a finned tube not provided with an open-celled porous coating, the gap between adjacent fins should be within the range of 1 to 5 mils. However, from a practical standpoint, formation of fin gaps consistently within this range is extremely difficult to achieve using conventional fin forming and fin flattening techniques. In the present invention, the dimension of the fin gap may lie within the range of from 1 to 8 mils. Furthermore, consistency of fin gap dimension is not a requirement.

Instead of relying on forming fins having a proper fin gap to produce nucleate boiling at low superheat, in the present invention, a porous coating 30 is applied to the deformed tips of fins 21 to provide openings of the required size. As shown schematically in FIG. 2, porous coating 30 is applied using a flame-spraying nozzle 31. The method for applying a flame-sprayed surface comprising oxidized metallic particles is well explained in U.S. Pat. No. 3,990,862 to Dahl et al, the specification of which is here incorporated by reference. The only significant deviation from the process as explained in Dahl involves the orientation of the flame-spraying nozzle 31. To avoid spraying metallic particles into and on the root and sides of the fin cavities formed by fins 21, flame-spraying nozzle 31 is oriented at an angle of 45° to 60° relative to the axis of tube 20. As FIG. 2 shows, the porous coating 30 may be applied in the same operation in which fins 21 are produced and crushed to form fin gaps, or the flame-spraying operation may be completed independently of the fin forming operation. The attached table shows the conditions for flame-spraying deformed fins 21 to produce the preferred embodiment.

TABLE OF FLAME-SPRAYING CONDITIONS

Oxidizer Delivery Rate ($O_2$)—30 SCFH
Fuel Delivery Rate (Acetylene)—20 SCFH
Flame-Spraying Gun—METCO, Model 5P
Nozzle—P7-G
Powder Delivery Rate 18–20 gm/min.
Spray Angle—60° (relative to Tube)
Metallic Powder—Alcoa Co., A115 aluminum powder
Spray Distance (Line of Flight)—11" (1 to 2 Passes)
Coating Thickness—3 to 8 mils In the preferred embodiment manufactured as shown in FIG. 2, copper tube 20 has a wall thickness of approximately 0.032". Helical fins 21 are formed on its outer surface with a fin density of approximately 64 fins per inch. Prior to being deformed by roller 24, fins 21 are approximately 8 mils from root to fin tip and 8 mils thick. Likewise, the spacing between adjacent fins 21 is approximately 8 mils. After the fins 21 are flattened by roller 24, they measure approximately 6 mils from root to fin tip. These dimensions are believed to produce an economical heat transfer tube, since they allow for a minimum amount of copper to be used therein.

In a flat or curved plate heat transfer surface 10 according to the present invention, fins 11 may be formed either by rolling with discs, or by a plowing operation, prior to their deformation. Fin tips 13 may alternatively be deformed by a splitting roller, or rolled over to form gaps between adjacent fin tips. These and other methods of forming fins and deforming their tips to form fin gaps are well known to those skilled in the art.

Turning again to FIG. 1, the mechanism by which the subject invention provides efficient nucleate boiling, particularly with liquids such as R-11 will now be discussed. Liquid is drawn by capillary force into fin cavities 15 through porous coating 16, at openings 17 which are distributed at random points along the fin gap 14. Inside cavities 15, the liquid is superheated by heat transferred through metal substrate 12. The superheated liquid vaporizes, forming bubbles which are emitted through openings 17 into the surrounding liquid. A substantial number of openings 17 are in the proper dimensional range, having a diameter of from 1 to 5 mils, such that in combination with fin cavities 15, they form efficient nucleate boiling sites. Openings 17, which are of larger dimension than the optimum range, allow vapor bubbles to completely escape without retaining a portion thereof as a seed for further bubble formation, yet these larger openings 17 may contribute to the efficiency of the process by providing means for liquid to feed into cavities 15.

Superheated liquid is retained within fin cavities 15 and flows laterally therein to openings 17 where vapor bubbles are emitted. The retention of this superheated liquid adjacent nucleate boiling sites minimizes the influx of cooler liquid which is not superheated, and also contributes to the overall heat transfer efficiency of the nucleate boiling process.

The relative abundance of openings 17 of the optimum dimension overlying gaps 14 insures a relatively high heat transfer efficiency of surface 10. Pool boiling tests of surface 10 at a constant heat flux per unit length of tube, wherein the difference in temperature of that surface and the liquid immediately adjacent thereto was measured to determine its efficiency, have indicated a superheat for boiling R-11 of approximately 1.8° F. By comparison, similar tests at the same heat flux conducted upon a porous boiling surface applied to a smooth copper tube as taught in the Dahl patent have resulted in a superheat of approximately 2.7° F. A lower temperature difference, or $\Delta T$, indicates a higher heat transfer efficiency. It will therefore be apparent, that the combination of fin cavities 15 and porous coating 16 provides substantially improved efficiency for boiling R-11. It is believed that surface 10 would also show an excellent heat transfer efficiency for boiling other liquids.

Although in the preferred embodiment of the subject invention, a flame-spraying process is used in combination with the fin cavities 15, other porous open-celled layers, such as a sintered or electro-plated coating may also be used. The open-celled structure of such a coating compensates for the relatively variable fin gap 14 to provide openings of the required dimension into cavities 15 to promote efficient nucleate boiling. It will be understood that modifications such as those noted above will be apparent to those skilled in the art within the scope of the invention, as defined in the claims which follow.

We claim:

1. A heat exchange surface comprising means for vaporizing a liquid, said means including continuous subsurface cavities formed in a metallic surface, said cavities being generally abridged where they are open onto the exterior of the metallic surface, by a porous open-celled coating deposited thereon, except at random points at which the cavities are directly open to the liquid said porous coating providing nucleate boiling cavities by its open-cell structure and its random open points in combination with the subsurface cavities, and thereby adapted to provide improved efficiency in boiling the liquid which is in fluid communication with the subsurface cavities.

2. A heat exchange surface comprising: a metallic surface having a plurality of generally parallel fins formed thereon, the tips of said fins being deformed to generally define a gap between adjacent fins opening into a fin cavity at the root portions thereof; a porous, open-celled coating deposited on the deformed portion of the fins, substantially bridging the gap between adjacent fins except at random open points caused by the inherent porosity of the coating, said porous coating in combination with the fin cavities, providing nucleate boiling cavities, and thereby adapted to provide improved efficiency in boiling a liquid.

3. The heat exchange surface of claim 2 wherein the fin tips are flattened or split into a generally "T"-shaped configuration, with the gaps being defined between the flattened or split portions of adjacent fins.

4. The heat exchange surface of claim 2 wherein the fin tips are turned over toward the side portions of adjacent fins, with the gaps being defined between the turned-over tips and sides of adjacent fins.

5. The heat exchange surface of claim 3 or 4 wherein the average gap width, as measured between adjacent fins, is within the range of 1 to 8 mils.

6. The heat exchange surface of claim 3 or 4 wherein the metallic surface is the external surface of a metal tube.

7. The heat exchange surface of claim 6 wherein the fins form a helical spiral around the tube.

8. The heat exchange surface of claim 1, 3, or 4 wherein the average thickness of the porous coating is at least 5 mils.

9. The heat exchange surface of claim 1, 3, or 4 wherein said porous open-celled coating comprises oxidized metallic particles flame-sprayed onto the metallic surface.

10. The heat exchange surface of claim 5 wherein the metallic particles are aluminum or aluminum containing alloy.

* * * * *